United States Patent [19]

Aida et al.

[11] Patent Number: 4,849,324

[45] Date of Patent: Jul. 18, 1989

[54] METHOD OF PROCESSING SILVER HALIDE COLOR PHOTOGRAPHIC MATERIAL USING A REDUCED AMOUNT OF REPLENISHER

[75] Inventors: Shunichi Aida; Morio Yagihara; Shinzo Kishimoto; Hiroshi Fujimoto, all of Minami-ashigara, Japan

[73] Assignee: Fuji Photo Film Co., Ltd., Minami-ashigara, Japan

[21] Appl. No.: 188,142

[22] Filed: Apr. 21, 1988

Related U.S. Application Data

[63] Continuation of Ser. No. 869,918, Jun. 3, 1986, abandoned.

[30] Foreign Application Priority Data

Jun. 7, 1985 [JP] Japan ..... 60-123943

[51] Int. Cl.[4] ..... G03C 5/24; G03C 5/30; G03C 1/06

[52] U.S. Cl. ..... 430/445; 430/446; 430/600; 430/611; 430/613; 430/614

[58] Field of Search ..... 430/445, 446, 600, 611, 430/613, 614

[56] References Cited

U.S. PATENT DOCUMENTS

| | | | |
|---|---|---|---|
| 4,310,622 | 1/1982 | Onda et al. | 430/445 |
| 4,328,302 | 5/1982 | Nishimura et al. | 430/445 |
| 4,390,613 | 6/1983 | Mehta et al. | 430/445 X |
| 4,391,900 | 7/1983 | Toyoda et al. | 430/445 X |
| 4,418,140 | 11/1983 | Mifune et al. | 430/445 |
| 4,524,129 | 6/1985 | Kishimoto et al. | 430/445 |
| 4,610,954 | 9/1986 | Torigoe et al. | 430/445 |
| 4,634,660 | 1/1987 | Mifune et al. | 430/445 |

FOREIGN PATENT DOCUMENTS 940169 10/1963 United Kingdom .

*Primary Examiner*—Mukund J. Shah

*Attorney, Agent, or Firm*—Burns, Doane, Swecker & Mathis

[57] ABSTRACT

In a process for the continuous treatment of silver halide color photographic light-sensitive materials with supplying a replenisher to a developing bath, the amount of the replenisher is 900 m or less per $m^2$ of the light-sensitive materials, and the light-sensitive materials contain a certain type of mercapto heterocyclic compounds. Constant results in finished development and lower fog are attained and fogging during storage of raw light-sensitive materials is suppressed even when the amount of the replenisher is very small.

17 Claims, No Drawings

METHOD OF PROCESSING SILVER HALIDE COLOR PHOTOGRAPHIC MATERIAL USING A REDUCED AMOUNT OF REPLENISHER

This application is a continuation, of application Ser. No. 869,918, filed Jun. 3, 1986, now abandoned.

BACKGROUND OF THE INVENTION

1. Field of the Invention

The present invention relates to a method of processing of silver halide color photographic materials, particularly a method of processing of silver halide color photographic materials wherein the volume of a replenisher is decreased.

2. Description of the Prior Art

Development processing of silver halide color photographic materials basically consists of two major steps, i.e., color-developing (in the case of color reversal material, black-and-white first development prior to that) and desilvering. Desilvering consists of bleaching and fixing steps, or a mono-bath bleach-fixing step which may be conducted together with the former steps or alone. In the case of necessity, additional treatment steps such as water washing, stop treatment, stabilizing treatment and pretreatment for the acceleration of development may further be added.

In color development, exposed silver halide is reduced to silver and, at the same time, oxidized aromatic primary amine developing agents react with couplers to form dyes. During this process, halide ions evolving through dissociation of silver halide are eluted in a developing solution and accumulate therein. Meanwhile, color development agents are exhausted by reaction with the aforesaid couplers. Further, other constituents are taken out by being held in photographic materials and concentrations of the constituents in the developing solution decrease. Accordingly, in a process for the continuous development processing of a large amount of silver halide photographic materials, for instance, by an auto-developing machine, required is a means to maintain concentrations of constituents of a color-developing solution in a certain range in order to avoid fluctuations of results of finished development due to changes in the concentrations of the constituents.

For instance, constituents to be consumed such as a developing agent and a preservative may be incorporated in a replenisher in a high concentration when such a high concentration has little influence. In some cases, the concentrations of eluted materials, such as halogen, which have an effect of suppressing development are set low in a replenisher or such materials are not included. Further, some compounds may be included in a replenisher so as to preclude influences of eluted materials. Alternatively, a pH or concentrations of alkali or chilate agents may be controlled. As a means for the above, it is usual to add a replenisher which supplies short constituents and dilute increasing constituents. A large volume of overflow liquid necessarily occurs as a result of such addition of the replenisher, which causes problems in process economy and environment protection.

The volume of the replenisher for a developing solution is generally 1,100 to 1,300 ml per $m^2$ of light-sensitive material to be treated, depending somewhat upon which types of light-sensitive materials are to be treated. A smaller amount of the replenisher is more desirable from the above-mentioned viewpoint. However, it becomes difficult to obtain constant results of finished development and, accordingly, it is impossible in practice to decrease the amount of the replenisher below the aforesaid range.

Another reason for the fluctuations of results of finished development is a dense fog caused in a development process of silver halide color photographic materials and a change of a fog during storage of raw light-sensitive materials. Light-sensitive materials having a high foggy property have a tendency of showing a large difference in fog between development conditions where the temperature of a developing solution rises or its pH rises to facilitate fogging and development conditions where the temperature or pH lowers to inhibit fogging. As a result, large fluctuations of results of finished development are often seen. No further explanation is required for that such light-sensitive materials as having a large change in fog during storage of the raw materils have a tendency of exhibiting large fluctuations of results of finished development.

Inclusion of various antifoggants in light-sensitive materials is known as a means to prevent fogging in silver halide color photographic materials and to solve the problem of increased fog during storage of the raw materials.

That is, heterocyclic mercapto compounds are known as antifoggants having a remarkable effect of inhibition of fogging or suppresion of increasing fogging during storage of the raw materials, such as mercapto thiazoles, mercapto benzthiazoles, mercapto benzimidazoles, mercapto thiadiazoles, mercapto tetrazoles, especially 1-phenyl-5-mercapto tetrazole, and mercapto pyrimidines.

It is recognized that the above antifoggants or stabilizers successfully suppress fogging during storage of the raw materials and lower the fluctuations of results of finished development when normal supply of a replenisher is done. However, if the volume of the replenisher for the developing solution is decreased, such antifoggants or stabilizers included in the light-sensitive materials cause an adverse effect of rather magnifying the fluctuations of results of finished development, and in particular changes in sensitivity.

SUMMARY OF THE INVENTION

The purpose of the present invention is to provide a method of processing continuously, silver halide color photographic materials by supplying a replenisher, which process permits a decrease in the amount of the replenisher and, in addition, lowering of fluctuations of results of finished development.

The present inventors have found that the inclusion of at least one compound represented by the following formula I in silver halide color photographic light-sensitive materials can suppress fluctuations of results of finished development, lower fog and suppress fogging during storage of the raw materials, even when continuous development treatment is conducted with a volume of a replenisher of 900 ml or less per $m^2$ of light-sensitive materials to be developed.

That is, the present invention provides a method of processing continuously, silver halide color photographic light-sensitive materials by supplying a replenisher to a developing solution, characterized in that a volume of the replenisher is 900 ml or less per $m^2$ of light-sensitive materials to be developed and that the light-sensitive materials include at least one compound represented by the following formula I:

$Q—SM^1$ wherein Q represents a heterocyclic residue to which at least one selected from a group consisting of $—SO_3M^2$, $—COOM^2$, —OH and $—NR^1R^2$ is directly or indirectly attached, $M^1$ and $M^2$ independently represent a hydrogen atom, alkali metal, quarternary ammonium ion, quarternary phosphonium ion, and $R^1$ and $R^2$ represent a hydrogen atom or a substituted or unsubstituted alkyl group.

The compounds represented by formula I are believed to flow out from the light-sensitive materials to the developing solution as they are rendered water-soluble or their water solubility is elevated in a pH atmosphere of the developing solution. In other words, when those compounds of formula I are included in the light-sensitive materials, the developing solution must be contaminated with those compounds. Nonetheless, fluctuations of results of finished development are small and a fog is thin, which is utterly surprising. Reasons for such unexpected effects are unclear and will be clarified by future study. However, it is believed for the time being that the compounds of formula I behave in very different manners in the light-sensitive materials and in the developing solution.

DETAILED DESCRIPTION OF THE INVENTION

Regarding light-sensitive materials including the compounds of formula I used in the present invention, Japanese Patent Publication 9939/1983 discloses silver halide color light-sensitive materials including heterocyclic mercapto compounds having at least one group selected from $—SO_3H$, —COOH, —OH and, $—NH_2$. However, this patent publication does not refer to whether or not such light-sensitive materials may solve the aforesaid problems when development treatment is conducted with a smaller amount of a replenisher for a developing solution.

As examples of the heterocyclic residue represented by Q in formula I there are mentioned oxazole, thiazole, imidazole, selenazole, triazole, tetrazole, thiadiazole, oxadiazole, pentazole, pyrimidine, thiadia, triazine, thiadiazine rings, and rings fused with other carbon rings or hetero rings, such as benzthiazole, benztriazole, benzimidazole, benzoxazole, benzselenazole, naphthoxazole, triazaindolizine, diazaindolizine, tetrazaindolizine rings.

Particularly preferred mercapto heterocyclic compounds of formula I include those represented by the following formula II and III:

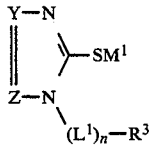

(II)

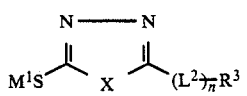

(III)

In formula II, Y and Z independently represent a nitrogen atom or $CR^4$ wherein $R^4$ is a hydrogen atom, a substituted or unsubstituted alkyl group or a substituted or unsubstituted aryl group. $R^3$ is an organic residue substituted with at least one selected from a group consisting of $—SO_3M_2$, $—COOM_2$, —OH and $—NR^1R^2$, more specifically a thus substituted alkyl group of 1 to 20 carbons such as methyl, ethyl, propyl, hexyl, dodecyl or octadecyl group, or a thus substituted aryl group of 6 to 20 carbons such as phenyl and naphthyl groups. $L^1$ represents a connecting group selected from a group consisting of —S—, —O—, $$—\overset{|}{N}—,$$

—CO—, —SO— and $—SO_2—$. n is zero or 1.

Those alkyl and aryl groups may be substituted with other substituents, for instance, halogen atoms such as F, Cl and Br, alkoxy groups such as methoxy and methoxyethoxy, aryloxy groups such as phenoxy, alkyl groups in the event that $R^2$ is an aryl group, aryl group in the event that $R^2$ is an alkyl group, amido groups such as acetamido group and benzoylamido group, carbamoyl groups such as unsubstituted carbamoyl group, phenylcarbamoyl group and methylcarbamoyl group, sulfonamido groups such as methansulfonamide group and phenylsulfonamide group, sulfamoyl groups such as unsubstituted sulfamoyl group, methylsulfamoyl group and phenylsulfamoyl group, sulfonyl groups such as methyl sulfonyl group and phenylsulfonyl group, sulfinyl groups such as methylsulfinyl group and phenylsulfinyl group, cyano group, alkoxycarbonyl groups such as methoxycarbonyl group, aryloxycarbonyl groups such as phenoxycarbonyl group, and nitro group.

When two or more substituents, $—SO_3M_2$, $—COOM_2$, —OH and $—NR^1R^2$, are present on $R^3$, those may be the same with or different from each other.

$M^2$ is the same as defined in formula I.

In formula III, X represents a sulfur atom, oxygen atom or $$—\underset{R^5}{\overset{|}{N}}—$$

wherein $R^5$ is a hydrogen atom, a substituted or unsubstituted alkyl group or a substituted or unsubstituted aryl group.

$L^2$ represents $—CONR^6—$, $—NR^6CO—$, $—SO_2NR^6—$, $—NR^6SO_2—$, —OCO—, —COO—, —S—, $—NR^6—$, —CO—, —SO—, —OCOO—, $—NR^6CONR^7—$, $—NR^6COO—$, $—OCONR^6$ or $—NR^6SO_2NR^7—$. $R^6$ and $R^7$ each represent a hydrogen atom, a substituted or unsubstituted alkyl group or a substituted or unsubstituted aryl group.

$R^3$ and $M^2$ are the same as defined in formulae I and II, and n represents zero or 1.

As examples of substituents for alkyl and aryl groups represented by $R^4$, $R^5$, $R^6$ and $R^7$, there are mentioned those named for $R_3$.

In the general formula, $R^3$ is preferably $—SO_3M^2$ or $—COOM^2$.

The following are examples of preferred compounds represented by general formula I:

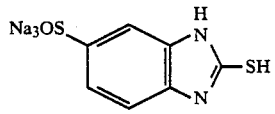

(1)

-continued
(2)
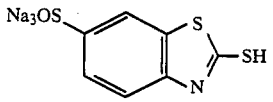
(3)
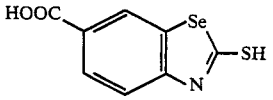
(4)
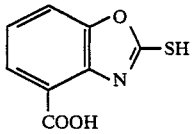
(5)
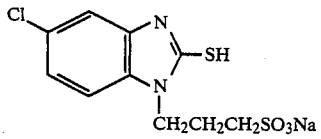
(6)
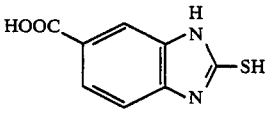
(7)
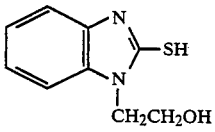
(8)
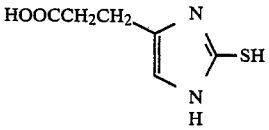
(9)
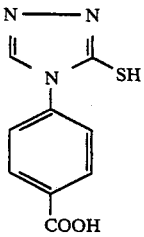
(10)
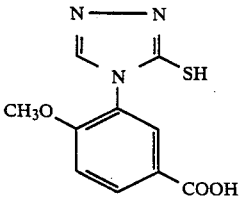
-continued
(11)
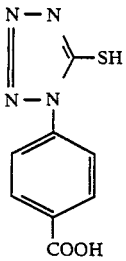
(12)
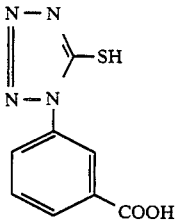
(13)
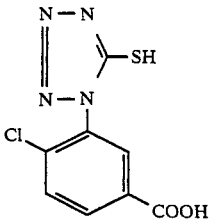
(14)
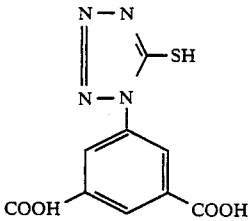
(15)
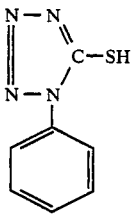
(16)
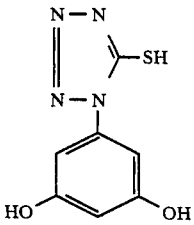

-continued
(17)
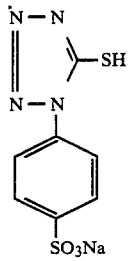
(18)
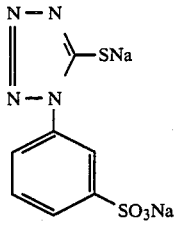
(19)
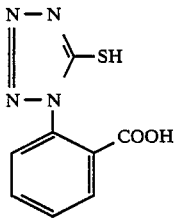
(20)
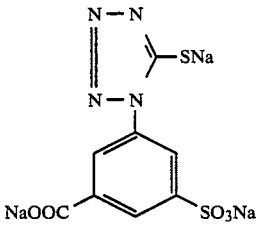
(21)
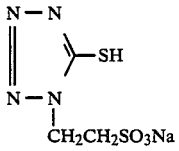
(22)
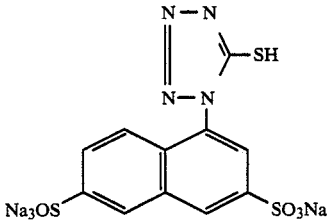
(23)
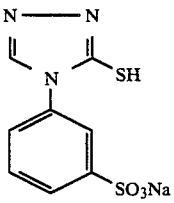
-continued
(24)
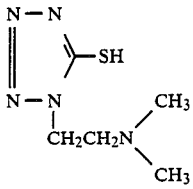
(25)
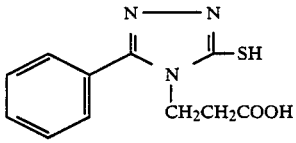
(26)
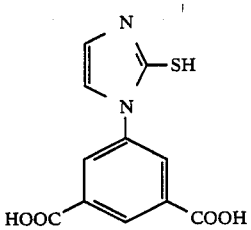
(27)
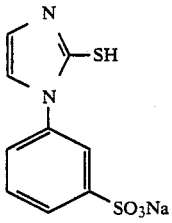
(28)
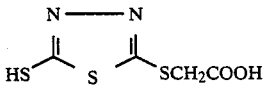
(29)
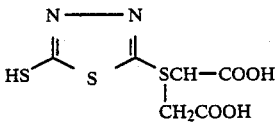
(30)
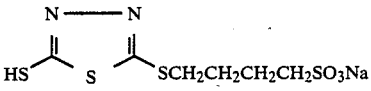
(31)
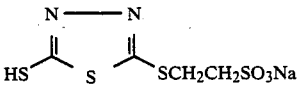
(32)
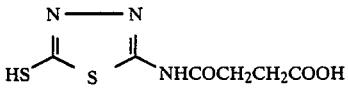
(33)
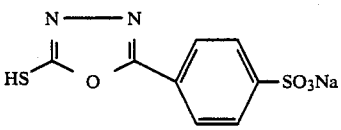
(34)
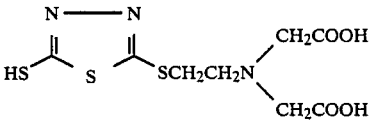

-continued (35)

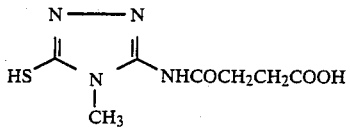

(36)

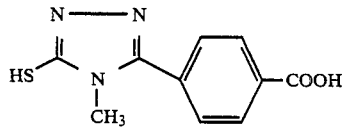

(37)

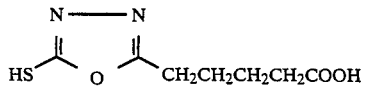

(38)

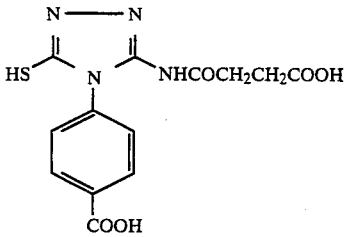

(39)

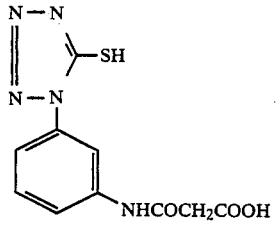

The compounds represented by general formula I are known, and can be synthesized according to the methods described in the following materials:

U.S. Pat. Nos. 2,585,388 and 2,541,924, Japanese Patent Publication 21,842/1967, Japanese Patent Publication (unexamined) 50,169/1978, G.B. Patent 1,275,701; D.A. Berges et al., Journal of Heterocyclic Chemistry, vol. 15, No. 981 (1978); "The Chemistry of Heterocyclic Chemistry" Imidazole and Derivatives part I), pp 336–339; Chemical Abstracts 58, 7921 (1963), pp 394; E. Hoggarth, "Journal of Chemical Society", pp 1160–7 (1949); S.R. Saudler, W. Karo, "Organic Functional Group Preparation" Academic Press pp 312–5, (1968); M. Chamdon, et al., Bulletin de la Societe Chimique de France, 723 (1954); D.A. Shirley, D.W. Alley, J. Amer. Chem. Soc., 79, 4922 (1954); A. Wohl, W. Marchwald, Ber. vol. 22, pp 568 (1889); J. Amer. Chem. Soc., 44, pp 1502–10;

U.S. Pat. Nos. 3,017,270, G.B. Patent 940,169, Japanese Patent Publication 8,334/1974, Japanese Patent Publication (unexamined) 59,463/198; Advanced in Heterocyclic Chemistry, 9, 165–209 (1968); West Germany Patent 2,716,707; The Chemistry of Heterocyclic Compounds Imidazole and Derivatives, vol 1, pp 384; Org, Synth., IV., 569 (1963); Ber., 9, 465 (1976); J. Amer. Chem. Soc., 45, 2390 (1923); Japanese Patent Publications (unexamined) 89,034/1975, 28,426/1978 and 21,007/1980; and Japanese Patent Publication 28,496/1965.

The compounds represented by general formula I may be included in a silver halide emulsion layer or a hydrophilic colloid layer such as an intermediate layer, a surface protective layer, a yellow filter layer, an antihalation layer and so on.

They are preferably included in the silver halide emulsion layer or its vicinal layers.

A preferred amount of them to be included is in a range of from $1\times10^{-5}$ to $1\times10^{-1}$ g.m/$^2$, more preferably from $1\times10^{-4}$ to $4\times10^{-3}$ g/m$^2$, most preferably from $5\times10^{-4}$, to $2\times10^{-3}$ g/m$^2$.

Various couplers may be used in the silver halide color photographic materials according to the present invention. For instance, cyan, magenta and yellow dye forming couplers disclosed in the patents cited in Research Disclosure, December, 1978, 17643 VII-D; and November, 1979, 18717, are mentioned. Couplers are preferably those which are rendered resistant to diffusion by introduction of ballast groups or by dimerization or polymerization. 4-Equivalent or 2-equivalent couplers may be used. A coupler which permits to improve a granular property by diffusion of formed dyes or a DIR coupler which releases a development restrainer through a coupling reaction to cause an edge effect or an interlayer effect may also be used.

Further, compounds which release through a coupling reaction, a group that accelerates development or a group that causes fogging of silver halide may be used, such as those described in Japanese Patent Publication (unexamined) 150845/1982, 50439/1984, 157638/1984 and 170840/1984; Japanese Patent Application 146097/1983.

Larger effects by the compounds according to the invention may easily be obtained with a lower ratio of a 4-equivalent coupler and a higher ratio of a 2-equivalent coupler. It is preferred in practice that the ratio of the 4-equivalent coupler to the whole couplers included in a light-sensitive material should be 50 mol% or less, more preferably 40 mol% or less, most preferably 30 mol% or less.

Preferred yellow couplers include α-pivaloyl or α-benzoyl acetanilide type couplers which split off at a oxygen or nitrogen atom. As examples of these particularly preferred 2-equivalent couplers, there are mentioned yellow couplers of an oxygen atom splitting-off type described in U.S. Pat. Nos. 3,408,194; 3,447,928; 3,933,501; and 4,022,620, and yellow couplers of an nitrogen atom splitting-off type described in U.S Pat. Nos. 973,968; 4,314,023; Japanese Patent Publication 10739/1983, Japanese Patent Publication (unexamined) 132926/1975, DEOS 2,219,917; 2,261,361; 2,329,587; and 2,433,812. For magenta couplers, 5-pyrazolone type couplers, pyrazolo (5, 1-c) (1, 2, 4) triazoles described in U.S Pat. Nos. 3,725,067, and pyrazolo (5, 1-b) (1, 2, 4) triazole described in European Patent 119,860, may be used. Preferred is also a magenta coupler which is made 2-equivalent by a splitting-off group bound to a coupling active site through a nitrogen or sulfur atom. Preferred cyan couplers are those resistant to moisture and heat. As typical examples for them, there are mentioned phenol type couplers described in U.S. Pat. No. 3,772,002; 2,5-diacylamino phenol type couplers described in Japanese Patent Publication (unexamined) 31953/1984 and 3293/1983, and Japanese Patent Publication (unexamined) 6956/1984; phenol type couplers having a phenylureido group at 2-position and an acylamino group at 5-position described in U.S. Pat. No. 333,999; naphthol type couplers described in Japanese Patent Publication (unexamined) 237448/1985.

Colored couplers which are colored yellow or magenta may be used in combination in order to compensate for unnecessary subabsorption present in short wave side of main absorption of coloring dyes. These couplers are used in a form of an emulsion in an aqueous medium using high boiling organic solvents such as phthalic esters of 16 to 32 carbon atoms or phosphoric esters and further, if necessary, other organic solvents such as ethyl acetate. The standard amount of colored couplers to be used is 0.01 to 0.5 mole for yellow couplers, 0.003 to 0.3 mole for magenta couplers and 0.002 to 0.3 mole for cyan couplers, per mole of light-sensitive silver halide.

Any silver halide grains may be selected from silver bromide, silver iodobromide, silver iodochlorobromide, silver chlorobromide and silver chloride to be used in a photographic emulsion layer of the light-sensitive materials according to the invention. Preferred silver halide grains are silver iodobromide or silver iodochlorobromide including not higher than 30 mol% silver iodide. Particularly preferred is silver iodobromide including 2 to 25 mol% silver iodide.

In a process of development where the amount of a replenisher to a developing bath is decreased, effects of an average ratio of silver iodide to the whole silver halide included in light-sensitive materials on sensitivity in finished development have been examined under conditions that the compounds of general formula I are not added to the light-sensitive materials. It has been found that, when an average ratio of silver iodide becomes higher, there is a tendency that the sensitivity in finished development lowers. This tendency was not improved by the inclusion of the compounds of general formula I into the light-sensitive materials. As one reason for the above phenomenon, it is believed that, when a light-sensitive material with a high average ratio of silver iodide is developed, iodide ion is accumulated in a developing solution and, as a result, the performance of the developing solution deteriorates. As another reason, it is believed that in the case where an average ratio of silver iodide in a light-sensitive material is high, developing activity decreases and influence of development factors becomes prevailing, so that such a small change of the development solution as causing no problem in a light-sensitive material of a low average ratio of silver iodide may reveal itself as apparent change in finished development in the case of a light-sensitive material of a high average ratio of silver iodide.

As described above, it is desirable to lower an average ratio of silver iodide to the whole silver halide included in light-sensitive materials in the event that the amount of a replenisher to a developing bath is decreased. However, on the other hand, a decrease of the average ratio of silver iodide to silver halide in a light-sensitive material causes a problem of increased fog and increased changes in fogging and sensitivity during storage of the raw material.

When the compounds of general formula I according to the invention are used together in light-sensitive materials having a relatively low average ratio of silver iodide, the aforesaid problems, i.e., the increase of fog value and the change during the storage of raw materials, are simultaneously solved and, in addition, the fluctuations of results of finished development caused by the decrease of the amount of a replenisher becomes smaller.

In light of the above, it is preferred that an average ratio of silver iodide to the whole silver halide included in the light-sensitive materials according to the invention should be 8 mol% or less, more preferably 7 mol% or less, particularly 6 mol% or less.

The shape of silver halide grains is not particularly limited and may be so-called regular grains having a regular crystal form such as cubic, octahedral or fourteen-hedral, or may be of an irregular crystal form such as spherical or a form having crystal defects such as a twinning plane, or complex form thereof.

Regarding the size of silver halide grains, they may be micrograins of 0.1 micron or less, or large size grains having a diameter of projection area of up to 10 microns. Both a monodisperse emulsion which has a narrow distribution or a multidisperse emulsion which has a broad distribution may be used.

Photographic emulsions to be used in the present invention may be prepared according to, for instance, the methods described in P. Glafkides, Chimie et Physique Photographique, Paul Montel, 1967; G.F. Duffin, Photographic Emulsion Chemistry, Focal Press, 1966; and V.L. Zelikman et al, Making and Coating Photographic Emulsion, Focal Press, 1964.

Further, such flat grains as having an aspect ratio of 5 or more may also be used in the invention. Flat grains may briefly be prepared according to the method describes in Cleve, Photography Theory and Practice (1930), pp 131; Gutoff, Photographic Science and Engineering, vol. 14, pp 248–257 (1970); U.S. Pat. Nos. 4,414,310; and 4,433,048; and G.B. Patent 2,112,157.

Silver halide emulsions which are usually chemically sensitized though non-sensitized emulsions called a primitive emulsion, may also be used. For the chemical sensitization, there may be used the method described in H. Frieser ed., Die Grundlagen der Photographischen Prozesse mit Silberhalogeniden, Akademische Verlagsgesellschaft (1968).

That is, sulfur sensitization using sulfur-containing compounds capable of reacting with active gelatin or silver, such as thiosulfates, thioureas, mercapto compounds and rhodanines, reduction sensitization using reducing compounds such as stannous salts, amines, hydrazine derivatives, formamidine sulfinic acid, silane compounds, noble metal sensitization using noble metals such as gold compounds, and complex salts of metals of group VIII of the periodic law system such as platinum, iridium, palladium may be used alone or in combination.

Photographic emulsions used in the invention may be spectrally sensitized by methine dyes or others. Dyes to be used include cyanine dyes, merocyanine dyes, complex cyanine dyes, complex merocyanine dyes, holopolar cyanine dyes, hemicyanine dyes, styryl dyes and hemioxonol dyes. Particularly useful dyes are those belonging to cyanine dyes, merocyanine dyes and complex merocyanine dyes. In those dyes, any nuclei usually used in cyanine dyes may be adopted as basically reactive heterocyclic nuclei. Namely, pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus etc.; nuclei composed by fusing an alicyclic hydrocarbon ring with the aforesaid nuclei; and nuclei composed by fusing an aromatic hydrocarbon ring with the aforesaid nuclei, such as indolenine nucleus, benzindolenine nucleus, indole nucleus, benzoxazole nucleus, naphthooxazole nucleus, benzthiazole nucleus, naphthothiazole nucleus, benzselenazole nucleus, benzimidazole nucleus, quinaline nucleus, may be used. Those nuclei may be substituted on their carbon atoms.

For merocyanine dyes or complex merocyanine dyes, 5 or 6 membered heterocyclic nuclei, such as pyrrazoline-5-one-nucleus, thiohydantoin nucleus, 2-thiooxazalidine-2,4-dione nucleus, thiazoline-2,4-dione nucleus, rhodanine nucleus, thiobarbituric acid nucleus, may be used as a nucleus having a ketomethylene structure.

These sensitizing dyes may be used alone or in combination. A combination of sensitizing dyes are often used, particularly, for the purpose of supersensitization.

Dyes having no spectral sensitization effect per se or substances absorbing substantially no visual lights and showing supersensitization may be incorporated in the emulsions together with the sensitizing dyes. For instance, aminostilbene compounds substituted with a nitrogen-containing heterocyclic group, such as described in U.S. Pat. Nos. 2,933,390 and 3,635,721, aromatic organic acid formaldehyde condensate, such as described in U.S. Pat. No. 3,743,510, cadmium salts and azaindene compounds may be incorporated. The combinations described in U.S. Pat. Nos. 3,615,613; 3,615,641; 3,617,295; and 3,635,721, are particularly useful.

For the purpose of preventing fogging during preparation, storage or development of the light-sensitive materials, or stabilization of the performance, known antifoggants or stabilizers may be used in addition to the compounds represented by the aforesaid general formula I. Examples thereof and methods of use thereof are described in U.S. Pat. Nos. 3,954,474 and 3,982,947; Japanese Patent Publication 28660/1977; Research Disclosure 17643 (December 1978) VIA to VIM; and E.J. Birr, Stabilization of Photographic Silver Halide Emulsions, Focal Press (1974).

The light-sensitive materials used in the invention may include one or more surfactants for various purposes, for instance, as a coating aid or an antistatic, for improvement of slipping, emulsifying dispersion, prevention of adhesion or improvement of photographic properties such as development acceleration, contrast development and sensitization.

The light-sensitive materials used in the present invention may further include, in addition to the aforesaid additives, various stabilizers, anti-staining agents, developing agents or a precursor thereof, hardening agents, lubricants, mordants, matting agents, antistatic agents, plasticizers, anticolorfoggants, antidiscoloration agents, UV absorbing agents and other additives useful in photographic light-sensitive materials. Typical examples of those additives are described in Research Disclosure 17643 (December 1978) and 18716 (November, 1979).

The silver halide color light-sensitive materials used in the invention include color negative light-sensitive materials and color reversal light-sensitive materials which may or may not contain couplers.

The present invention may preferably be applied to high sensitive photographic color films which comprises a substrate having provided thereon, at least two emulsion layers which are the same in color sensitivity but different in speed. Layer arrangement is typically in an order of red-sensitive layers, green-sensitive layers and, then, blue-sensitive layers from the substrate, though high sensitive layers may be provided in such a reversed layer arrangement as being sandwiched with emulsion layers of different color sensitivities.

The amount of coated silver in the color light-sensitive material is preferably 10 g/m$^2$ or less, more preferably 7.5 g/m$^2$ or less, and particularly 5.5 g/m$^2$ or less.

It is preferred that in the color light-sensitive materials used in the invention, a non-light-sensitive silver halide micrograin emulsion is used in the hydrophilic colloid layer outside the photographic emulsion layer remotest from the substrate.

The non-light-sensitive fine silver halide grain emulsion layer which is provided outside the photographic emulsion layer furthest from the substrate bring effects of decreasing the amounts of substances such as the compounds of general formula I and so on, which have been absorbed on silver halide, to be eluted from the light-sensitive material into a developing solution and consequently, of preventing the above substances accumulated in the developing solution during continuous processing of various light-sensitive materials from acting on the light-sensitive silver halide in the ligh-sensitive materials.

The characteristic effect of the invention is small fluctuations of the results of finished development when the light-sensitive materials containing the compounds of general formula I is continuously treated with a decreased amount of a replenisher to a developing bath. In addition, this effect can be elevated by the use of light-sensitive materials wherein a non-light-sensitive fine silver halide grain emulsion layer is provided outside a photographic emulsion layer furthest from the substrate.

It is preferred that such fine silver halide grains are not substantially developed in a development process of silver halide color photographic lihht-sensitive materials. Further, it is preferred, as well, that the aforesaid fine silver halide grains are relatively non-light-sensitive. The expression, "relatively non-light-sensitive" used herein preferably means sensitivity lower by 0.5 or more in log unit, preferably 1.0 or more, than that of light-sensitive silver halide.

Such fine silver halide grains may be any of pure silver chloride, pure silver bromide, pure silver iodide, silver chlorobromide, silver iodobromide and silver chloroiodobromide with preference for grains containing at least 60 mol % silver bromide, 30 mol% or less silver chloride and 40 mol % or less silver iodide. Particularly, silver iodobromide grains with a silver iodide content of 10 mol% or less is preferred. The average grain size is 0.2 μm or less, preferably 0.15 μm or less, more preferably 0.1 μm or less.

The fine silver halide grains may have a relatively broad grain size distribution, but preferably have a narrow grain size distribution. Particularly, it is preferred that the size of 90%, in terms of weight or number, of the whole silver halide grains is within the average grain size ±40%.

The amount of the coated fine silver halide grains is preferably 0.03 to 2 g/m$^2$, more preferably 0.05 to 1 g/m$^2$. A binder of the layer containing the fine silver halide grains may be any hydrophilic polymers with particular preference for gelatin. The amount of the binder is preferably 250 g or less per mole of silver halide.

When colloidal silver is used in an antihalation layer or a yellow filter layer of light-sensitive materials, the colloidal silver may be stabilized by the use of waterinsoluble mercapto compound such as phenylmercaptotetrazole having a ballast group described in U.S. Pat No. 3,376,310 together with the colloidal silver.

The processing of the light-sensitive materials according to the invention is continuously conducted while supplying a replenisher to a developing bath. Any known manners may be used in this processing. The treatment liquid may be any known one. The temperature of treatment is usually set in a range of from 18° C. to 50° C. although a temperature below 18° C. or above 50° C. may also be chosen.

A color developing solution generally consists of an aqueous alkaline solution containing a color-developing agent. As the color-developing agent, known aromatic primary amines may be used, such as phenylene diamines including 4-amino-N,N-diethylaniline, 3-methyl-4-amino-N,N-diethylaniline, 4-amino-N-ethyl-N-β -hydroxyethylaniline, 3-methyl-4-amino-N-ethyl N-β-hydroxyethylaniline, 3-methyl-4-amino-N-ethyl-N-β-ethanesulfoneamid ethylaniline, 4-amino-3-methyl-N-ethyl-N-β-methoxyethylaniline.

Alternatively, those described in F. Mason, Photographic Processing Chemistry, Focal Press (1966), pp 226–2,193,015 U.S. Pat. Nos. 2,193,015 and 2,592,364; Japanese Patent Publication (unexamined) 64933/1973, may also be used.

For a black-and-white developing solution used in color reversal processing, any known developing agents may be used alone or in combination, for instance, dihydroxybenzenes such as hydroquinone, 3-pyrazolidones such as 1-phenyl-3-pyrazolidone, and aminophenols such as N-methyl-p-aminophenol.

The developing solution may further contain pH buffers such as sulfite, carbonate, borate and phosphate of alkali metals, and development inhibitors or antifoggants such as bromides, iodides and organic antifoggants. If necessary, it may also contain water-softening agents, preservatives such as hydroxylamine, organic solvents such as benzylalcohol and diethylene glycol, development accelerators such as polyethylene glycol, quarternary ammonium salts and amines, dye forming couplers, competing couplers, fogging agents such as sodium boronhydride, auxiliary developing agents such as 1-phenyl-3-pyrazolidone, thickners, polycarboxylic acid type chelating agents described in U.S. Pat. No. 083,723 and antioxdants described in DEOS 2,622,950.

The development process of the present invention is characterized in that the volume of a replenisher is decreased. The volume of a replenisher is 900 ml or less, preferably 800 ml or less, more preferably 600 ml, most preferably 500 ml, per $m^2$ of the light-sensitive materials.

In color photographic processing, photographic light-sensitive materials after color-developing processing are usually subjected to a bleaching process. The bleaching process may be conducted alone or together with a fixing process. Bleaching agents to be used include compounds of polyvalent metal such as Fe(III), Co(III), Cr(VI) and Cu(II), peracids, quinones, nitroso compounds. For instance, ferricyanic compounds, dichromates, organic complex of Fe(III) or Co(III) such as complexes of aminopolycarboxylic acids, for example, ethylendiaminetetraacetic acid, nitrilotriacetic acid and 1,3-diamino-2-propanol tetraacetic acid, organic acids, for instance, citric acid, tartaric acid and malic acid; persulfate, permanganate; and nitrosophenol. Among those, potassium ferricyanide, ferric sodium ethylenediaminetetraacetate and ferric ammonium ethylenediaminetetraacetate are particularly useful. (Ethylenediaminetetraacetato) iron(III) complex is useful both in a bleaching solution alone and in a single bath of bleach-fixing solution. Various compounds may be used as a bleaching accelerator in a bleaching solution, a bleach-fixing solution and/or a preceding bath thereof. For instance, compounds having a mercapto group or a disulfide group described in U.S. Pat. No. 858, German Patent 1,290,812, Japanese Patent Publication (unexamined) 95630/1978 and Research Disclosure 17129 (July, 1978), thiazolidine derivatives described in Japanese Patent Publication (unexamined) 140129/1975, thiourea derivatives described in U.S. Pat. No. 3,706,561, iodides described in Japanese Patent Publication (unexamined) 16235/1983, polyethyleneoxides described in German Patent 2,748,430 and polyamines described in Japanese Patent Publication (examined) 8836/1970, may be used.

The process of the present invention includes, as described earlier, processing steps such as color development, bleaching, fixing and so on. After a fixing step or a bleach-fixing step, washing and/or stabilization are usually carried out. However, a simplified method may also be conducted by carrying out only the washing step or by carrying out only the stabilizing step substantially without the washing step.

As occasion demands, conventional additives may be included in washing water for the washing step. For instance, chelating agents such as inorganic phosphoric acid, aminopoly carboxylic acid, organic phosphoric acid, bactericides or anti-mold agents for inhibition of various bacteria or mold, hardening agents such as magnesium salts and aluminium salts, and surfactants for preventing unevenness or the reduction of load for drying may be used. Alternatively, compounds described in L.E. West, "Water Quality Criteria" Phot. Sci. and Eng. vol. 9 No.6, pp 344–359 (1965), may be used.

Further, the washing step may be carried out using more than one bath, and multi-step counterflow washing (e.g., 2 to 9 steps) may be adopted to save washing water.

Regarding a stabilizing bath used in the stabilization step, a processing solution which stabilizes dye images may be used. For instance, a liquid having an ability of buffering at pH 3 to 6, and a liquid containing an aldehyde such as formalin may be used. In the stabilizing bath, fluorescent brightning agents, chelating agents, bactericides, anti-mold agents, hardening agents, surfactants may be used when necessary.

Further, the stabilization step may be carried out using more than one bath as occasion demands, and a multi-step counterflow method (e.g. 2 to 9 steps) may be adopted to save the stabilizing liquid. The water washing step may be omitted.

According to the invention, the volume of a replenisher to a developing bath can be decreased while minimizing fluctuations of the results of development. That is, it is possible to lower fogging in developing processing and to suppress rising fog and change in sensitivity during storage of the raw light-sensitive materials.

The light-sensitive materials to be treated according to the present invention include color negative films used for taking photographs, movies, etc., and color reversal films for slides, movies and so on.

The invention will be further explained in the following examples.

Example 1

A multilayered color photographic light-sensitive material consisting of layers which have the following compositions were prepared on a substrate of cellulose triacetate film which had been undercoated.

Composition of the light-sensitive layer

The coated amounts of silver halide and colloidal silver are expressed in gram of silver per $m^2$, the coated amounts of couplers, additives and gelatine are expressed in $g/m^2$, and the amount of sensitizing dyes are expressed in mole per mole of silver halide in the same layer.

| | |
|---|---|
| **1st Layer (Antihalation Layer)** | |
| black colloidal silver | 0.2 |
| gelatine | 1.3 |
| colored coupler C-1 | 0.06 |
| UV absorbant UV-1 | 0.1 |
| UV absorbant UV-2 | 0.2 |
| dispersion oil Oil-1 | 0.01 |
| dispersion oil Oil-2 | 0.01 |
| **2nd Layer (Intermediate Layer)** | |
| gelatine | 1.0 |
| colored coupler C-2 | 0.02 |
| dispersion oil Oil-1 | 0.1 |
| **3rd Layer (First Red-Sensitive Emulsion Layer)** | |
| silver iodobromide emulsion (silver iodide 2 mol %, average grain size 0.3μ) | 0.4 |
| gelatine | 0.6 |
| sensitizing dye I | $1.0 \times 10^{-4}$ |
| sensitizing dye II | $3.0 \times 10^{-4}$ |
| sensitizing dye III | $\times 10^{-5}$ |
| coupler C-3 | 0.06 |
| coupler C-4 | 0.06 |
| coupler C-8 | 0.04 |
| coupler C-2 | 0.03 |
| dispersion oil Oil-1 | 0.03 |
| dispersion oil Oil-2 | 0.012 |
| **4th Layer (Second Red-Sensitive Emulsion Layer)** | |
| silver iodobromide emulsion (silver iodide 5 mol %, average grain size 0.5μ | 0.7 |
| sensitizing dye I | $1 \times 10^{-4}$ |
| sensitizing dye II | $3 \times 10^{-4}$ |
| sensitizing dye III | $1 \times 10^{-5}$ |
| coupler C-3 | 0.24 |
| coupler C-4 | 0.24 |
| coupler C-8 | 0.04 |
| coupler C-2 | 0.04 |
| dispersion oil Oil-1 | 0.15 |
| dispersion oil Oil-3 | 0.02 |
| **5th Layer (Third Red-Sensitive Emulsion Layer)** | |
| silver iodobromide emulsion (silver iodide 10 mol %, average grain size 0.7μ) | 1.0 |
| gelatine | 1.0 |
| sensitizing dye I | $1 \times 10^{-4}$ |
| sensitizing dye II | $3 \times 10^{-4}$ |
| sensitizing dye III | $1 \times 10^{-5}$ |
| coupler C-6 | 0.05 |
| coupler C-7 | 0.1 |
| dispersion oil Oil-1 | 0.01 |
| dispersion oil Oil-2 | 0.05 |
| **6th Layer (Intermediate Layer)** | |
| gelatine | 1.0 |
| compound Cpd-A | 0.03 |
| dispersion oil Oil-1 | 0.05 |
| dispersion oil Oil-2 | 0.05 |
| **7th Layer (First Green-Sensitive Emulsion Layer)** | |
| silver iodobromide emulsion (silver iodide 4 mol %, average grain size 0.3μ) | 0.30 |
| sensitizing dye IV | $5 \times 10^{-4}$ |
| sensitizing dye V | $2 \times 10^{-4}$ |
| sensitizing dye VI | $0.3 \times 10^{-4}$ |

-continued

| | |
|---|---|
| gelatine | 1.0 |
| coupler C-9 | 0.2 |
| coupler C-5 | 0.03 |
| coupler C-1 | 0.03 |
| dispersion oil Oil-1 | 0.5 |
| **8th Layer (Second Green-Sensitive Emulsion Layer)** | |
| silver iodobromide emulsion (silver iodide 5 mol %, average grain size 0.5μ) | 0.4 |
| sensitizing dye IV | $5 \times 10^{-4}$ |
| sensitizing dye V | $2 \times 10^{-4}$ |
| sensitizing dye VI | $0.3 \times 10^{-4}$ |
| coupler C-9 | 0.25 |
| coupler C-1 | 0.03 |
| coupler C-10 | 0.015 |
| coupler C-5 | 0.01 |
| dispersion oil Oil-1 | 0.2 |
| **9th Layer (Third Green-Sensitive Emulsion Layer)** | |
| silver iodobromide emulsion (silver iodide 6 mol %, average grain size 0.7μ) | 0.85 |
| gelatine | 1.0 |
| sensitizing dye VII | $3.5 \times 10^{-4}$ |
| sensitizing dye VIII | $1.4 \times 10^{-4}$ |
| coupler C-11 | 0.01 |
| coupler C-12 | 0.03 |
| coupler C-13 | 0.20 |
| coupler C-1 | 0.02 |
| coupler C-15 | 0.02 |
| dispersion oil Oil-1 | 0.20 |
| dispersion oil Oil-2 | 0.05 |
| **10th Layer (Yellow Filter Layer)** | |
| gelatine | 1.2 |
| yellow colloidal silver | 0.08 |
| compound Cpd-B | 0.1 |
| dispersion oil Oil-1 | 0.3 |
| **11th Layer (First Blue-Sensitive Emulsion Layer)** | |
| monodisperse silver iodobromide (silver iodide 4 mol %, average grain size 0.3μ) | 0.4 |
| gelatine | 1.0 |
| sensitizing dye IX | $2 \times 10^{-4}$ |
| coupler C-14 | 0.9 |
| coupler C-5 | 0.07 |
| dispersion oil Oil-1 | 0.2 |
| **12th Layer (Second Blue-Sensitive Emulsion Layer)** | |
| silver iodobromide (silver iodide 10 mol %, average grain size 1.5μ) | 0.5 |
| gelatine | 0.6 |
| sensitizing dye IX | $1 \times 10^{-4}$ |
| coupler C-14 | 0.25 |
| dispersion oil Oil-1 | 0.07 |
| **13th Layer (First Protective Layer)** | |
| gelatine | 0.8 |
| UV absorbant UV-1 | 0.1 |
| UV absorbant UV-2 | 0.2 |
| dispersion oil Oil-1 | 0.01 |
| dispersion oil Oil-2 | 0.01 |
| **14th Layer (Second Protective Layer)** | |
| micrograin silver bromide (average grain size 0.07μ) | 0.5 |
| gelatine | 0.45 |
| polymethylmethacrylate particles (diameter 1.5μ) | 0.2 |
| hardening agent H-1 | 0.4 |
| formaldehyde scavenger S-1 | 0.5 |
| formaldehyde scavenger S-2 | 0.5 |

In addition to the above constituents, 4-hydroxy-6-methyl-(1, 3, 3*a*, 7) tetraazaindene as a stabilizer and surfactants as a coating aid were added to each layer. The sample prepared above was designated Sample 101.

Chemical structures or names of the compounds used in the above example will be shown below:

UV-1
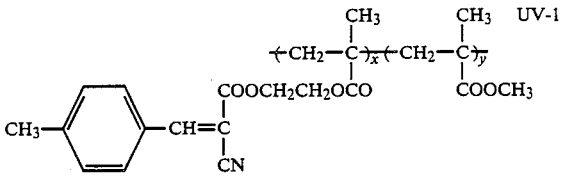
x/y = 7/3 (weight ratio)
UV-2
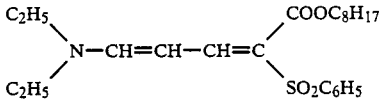
Oil-1 trycresyl phosphate
Oil-2 dibutyl phthalate
Oil-3
C-1
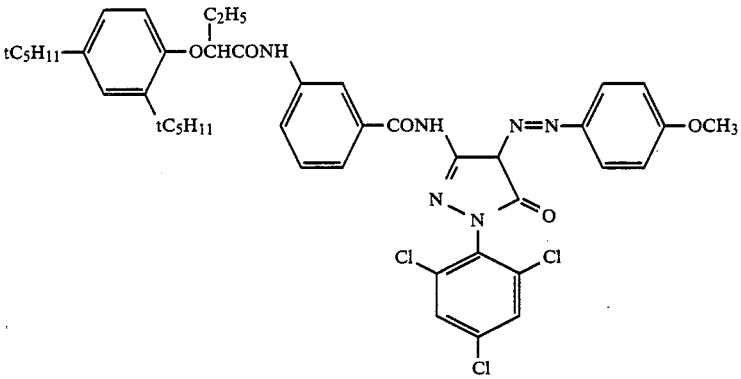
C-2
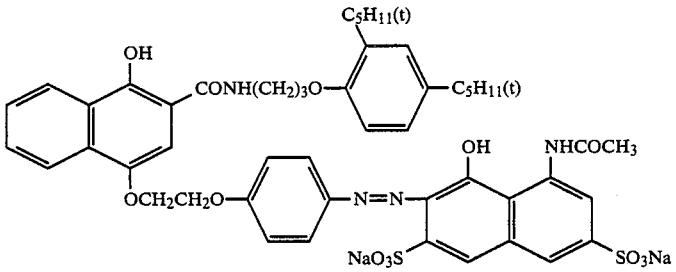
C-3
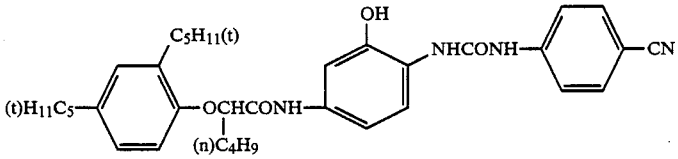
C-4
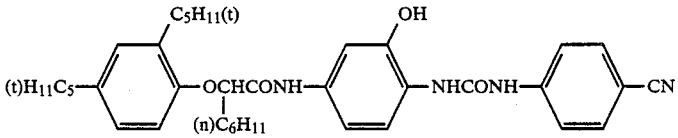
C-5
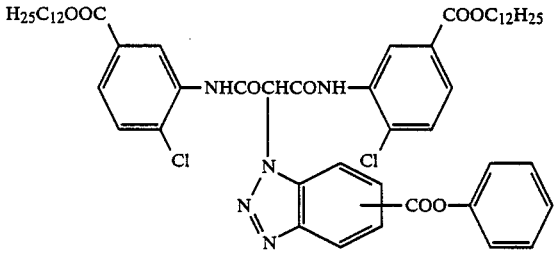

-continued
C-6
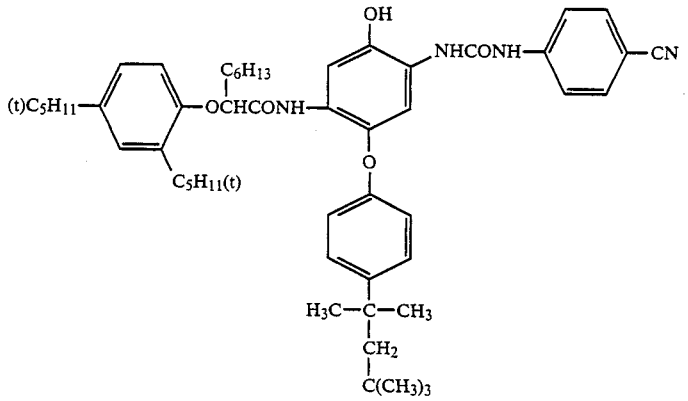
C-7
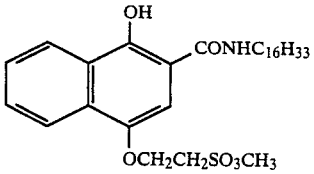
C-8
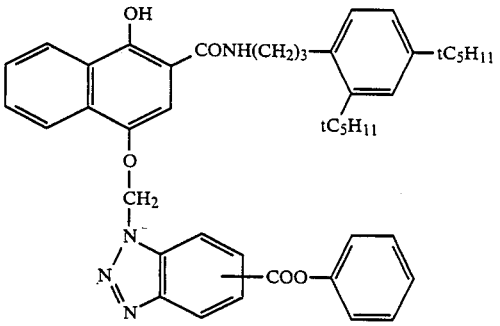
C-9
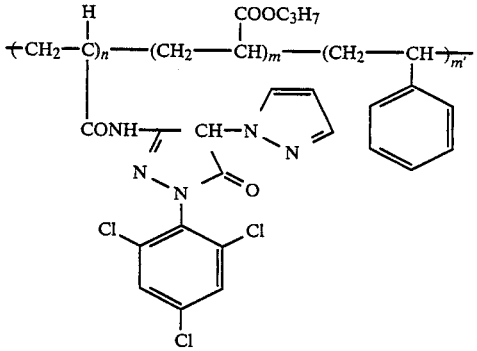
n = 50 wt. %
m = 33 wt. %
m' = 17 wt. %
molecular weight about 50,000
C-10
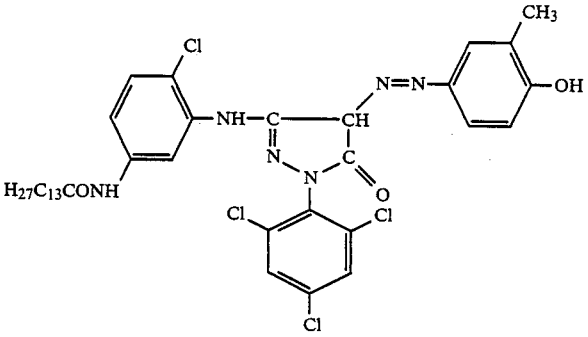

-continued
C-11
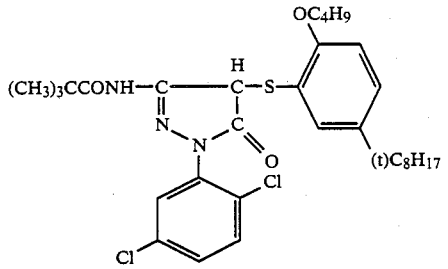
C-12
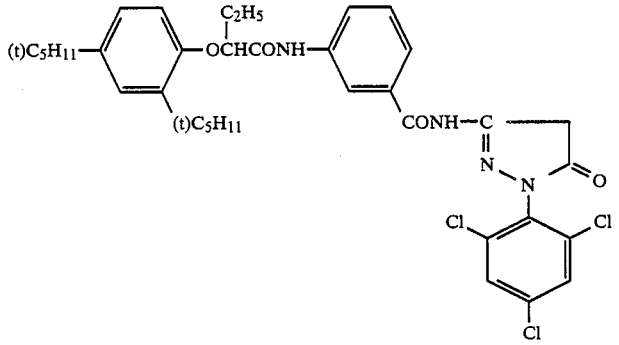
C-13
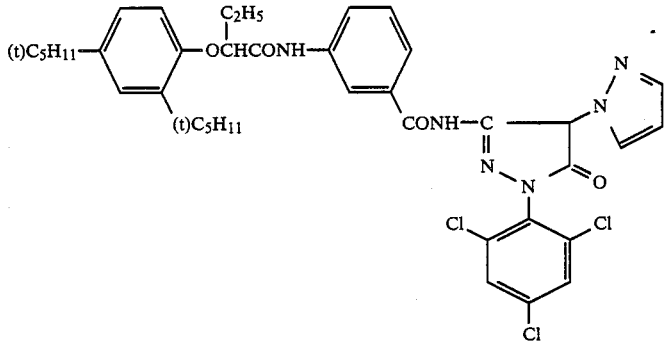
C-14
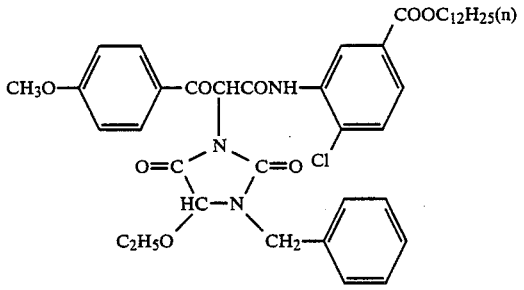
C-15
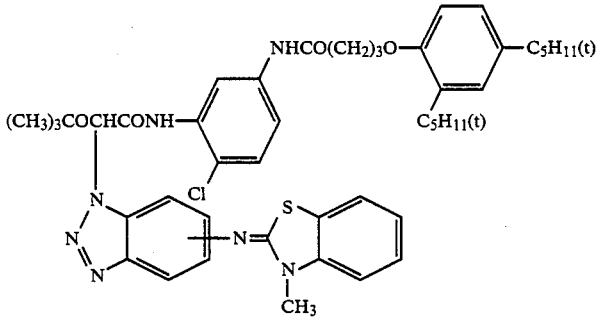

-continued
Cpd A
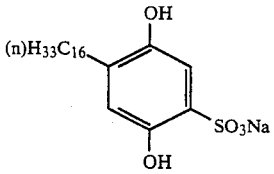
Cpd B
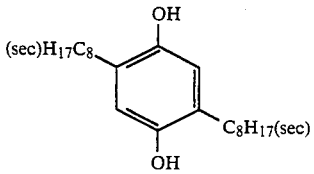
sensitizing dye I
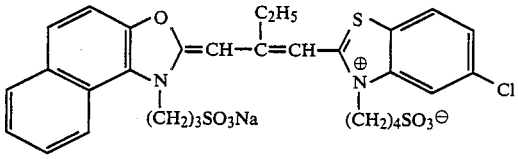
sensitizing dye II
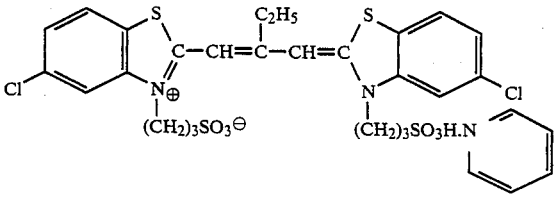
sensitizing dye III
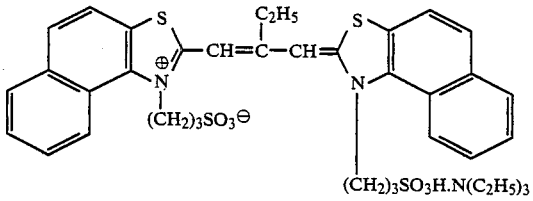
sensitizing dye IV
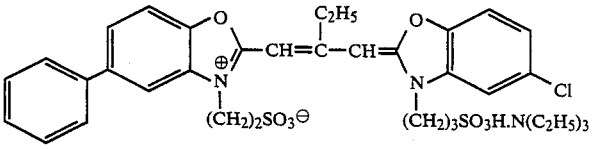
sensitizing dye V
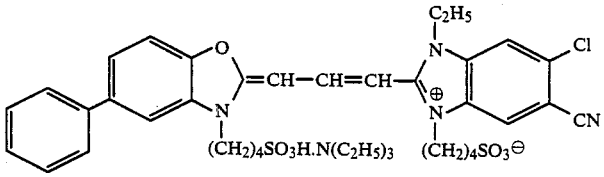
sensitizing dye VI
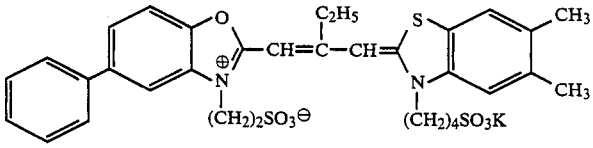
sensitizing dye VII
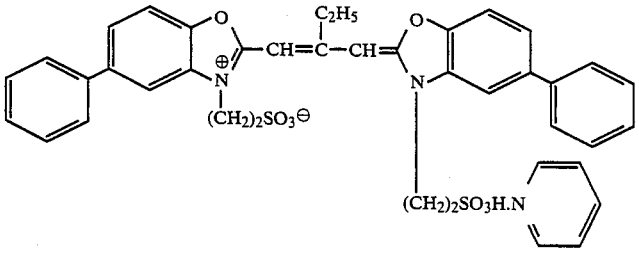

-continued

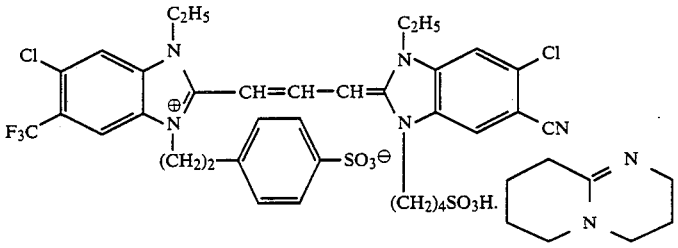

sensitizing dye VIII

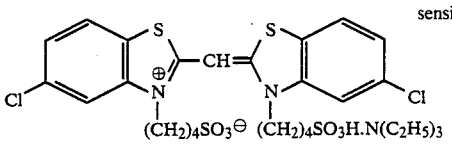

sensitizing dye IX

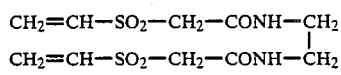

H-1

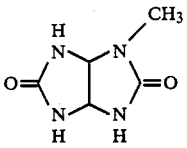

S-1

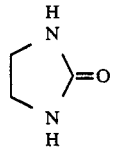

S-2

This photographic element was subjected to exposure of a tungsten lamp at 25 CMS adjusted to a color temperature of 4800° K. by a filter. Then, development was conducted at 38° C. according to the following steps:

| | |
|---|---|
| color development | 3 min. 15 sec. |
| bleaching | 6 min. 30 sec. |
| water washing | 2 min. 10 sec. |
| fixing | 4 min. 20 sec. |
| water washing | 3 min. 15 sec. |
| stabilization | 1 min. 5 sec. |

The compositions of the processing liquids used in the above steps will be shown below.

Developinq solution

The compositions of the mother liquid and the replenishers to a developing bath, $R_1$, $R_2$, $R_3$ and $R_4$, were as

| | Mother Liquid | $R_1$ | $R_2$ | $R_3$ | $R_4$ |
|---|---|---|---|---|---|
| diethylene triamine pentaacetatic acid | 0.8 g | 0.8 g | 0.8 g | 0.8 g | 0.8 g |
| 1-hydroxyethylidene-1,1-diphosphonic acid | 3.3 g | 3.3 g | 3.3 g | 3.3 g | 3.3 g |
| sodium sulfite | 4.0 g | 4.3 g | 4.4 g | 4.5 g | 4.6 g |
| potassium carbonate | 30.0 g | 37.0 g | 37.0 g | 39.0 g | 39.0 g |
| potassium bromide | 1.4 g | 0.7 g | 0.3 g | 0 | 0 |
| potassium iodide | 1.3 mg | 0 | 0 | 0 | 0 |
| hydroxylamine sulfate | 2.4 g | 2.8 g | 2.9 g | 3.0 g | 3.0 g |
| 4-(N—ethyl-N—β-hydroxyethyl-amino)-2-methyl aniline sulfate | 4.5 g | 5.4 g | 5.7 g | 6.3 g | 6.4 g |
| water to | 1.0 l | 1.0 l | 1.0 l | 1.0 l | 1.0 l |
| pH | 10.0 | 10.1 | 10.1 | 10.15 | 10.15 |

A pH was adjusted with 10% potassium hydroxide or 10% sulfuric acid.

| Bleaching solution | |
|---|---|
| ferric ammonium ethylenediamine tetraacetate | 100.0 g |
| disodium ethylenediamine-tetraacetate | 10.0 g |

-continued

| | |
|---|---|
| ammonium bromide | 150.0 g |
| ammonium nitrate | 10.0 g |
| water | to 1.0 l |
| pH | 6.0 |
| Fixing solution | |
| disodium ethylendiamine-tetraacetate | 1.0 g |
| sodium sulfite | 4.0 g |
| aqueous solution of ammonium thiosulfate (70%) | 175.0 ml |
| sodium hydrogen sulfite | 4.6 g |
| water | to 1.0 l |
| pH | 6.6 |
| Stabilization solution | |
| formalin (40%) | 2.0 ml |
| polyoxyethylene-p-monononylphenyl ether (average degree of polymerization approximately 10) | 0.3 g |
| water | to 1.0 l |

Next, Samples 102 and 105 were prepared by repeating the procedure of the preparation of Sample 101 with the exception that the compound according to the invention or compounds for comparison were added in coated amounts of $5 \times 10^{-4}$ g/m$^2$, $3 \times 10^{-4}$ g/m$^2$ and $2 \times 10^{-4}$ g/m$^2$ to the 5th layer, the 9th layer and the 13th layer, respectively.

Sample 102 compound (11) of the invention 103 compound (11A) for comparison

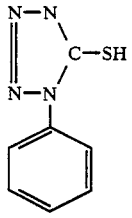

104 compound (28) of the invention 105 compound (28A) for comparison

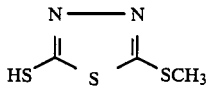

Preservation test

Samples 101 to 105 were stored at 60° C. and 30% RH for 3 days immediately after the preparation and, then, developed in the above processing conditions. Their sensitivities and fog values were measured to examine preservability. Only the mother liquid was used as a developing solution.

The results are shown in Table 1. The relative sensitivity in Table 1 is sensitivity of each layer based on the sensitivity of Sample 101 immediately after preparation (taken as 100). BL, GL and RL in Table 1 mean the blue-sensitive layer, the green-sensitive layer and the red sensitive layer, respectively.

TABLE 1

| Sample | Compound added to the 5th, 9th and 13th layers | Immediately after preparation Fog | Relative sensitivity | Fog at 60° C., 30% RH | Relative sensitivity after 3 days storage |
|---|---|---|---|---|---|
| 101 | — | BL ±0(standard for BL) | 100(standard for BL) | +0.15 | 76 |
| | | GL ±0(standard for GL) | 100(standard for GL) | +0.16 | 74 |
| | | RL ±0(standard for RL) | 100(standard for RL) | +0.20 | 70 |
| 102 | (11) | BL −0.02 | 102 | +0.03 | 100 |
| (invention) | | GL −0.03 | 100 | +0.04 | 98 |
| | | RL −0.02 | 105 | +0.05 | 102 |
| 103 | comparison compound (11A) | BL −0.03 | 90 | +0.02 | 87 |
| | | GL −0.04 | 85 | +0.02 | 81 |
| | | RL −0.03 | 95 | +0.04 | 90 |
| 104 | (28) | BL −0.02 | 100 | +0.05 | 99 |
| (invention) | | GL −0.02 | 100 | +0.07 | 97 |
| | | RL −0.01 | 103 | +0.08 | 100 |
| 105 | comparison compound (28A) | BL −0.02 | 99 | +0.04 | 97 |
| | | GL −0.02 | 100 | +0.07 | 97 |
| | | RL −0.01 | 102 | +0.08 | 97 |

As seen from Table 1, fog increases and sensitivity decreases with time in Sample 101 to which no compound was added. In contrast, when the compounds listed in Table 1 were used, it was possible to inhibit the increase of fog and the decrease of sensitivity.

Processability test

Each of Samples 101 to 105 was subjected to running treatment in four different conditions and the sensitivities of the blue-sensitive layers which are liable to be easily affected were measured in 10th day. The results are shown in Table 2. The shown sensitivities are relative sensitivities based on the sensitivity of Sample 101 of 100.

The running treatment were begun with the aforesaid mother liquid and, then, the above-mentioned replenishers, $R_1$ to $R_4$, were used in the following amount:

$R_1$: 1150 ml/m$^2$
$R_2$: 900
$R_3$: 600
$R_4$: 500

TABLE 2

| Sample | Replenisher $R_1$ | $R_2$ | $R_3$ | $R_4$ |
|---|---|---|---|---|
| 101 | 100 (standard) | 98 | 96 | 94 |
| | ±0 (standard) | −0.01 | −0.01 | −0.02 |
| 102 | 102 | 100 | 99 | 98 |
| | −0.02 | −0.02 | −0.02 | −0.02 |
| 103 | 98 | 92 | 85 | 77 |
| | −0.03 | −0.04 | −0.05 | −0.06 |
| 104 | 102 | 101 | 100 | 99 |
| | −0.02 | −0.02 | −0.02 | −0.02 |
| 105 | 100 | 94 | 87 | 81 |
| | −0.02 | −0.03 | −0.04 | −0.05 |

In each column, the upper line is relative sensitivity; the lower line, fog value.

As seen from Table 2, Samples 102 and 104 where the compound according to the invention was used showed little change in sensitivity even in the running treatment with the decreased amount of the replenishers.

In addition, the change in fog value was suppressed as well.

Example 2

Samples 111 and 112 were prepared in the same way as Samples 111 in Samples 101 and 102, respectively, with the exception that fine silver bromide grains were not included in the 14th layer. Sample 101, 102, 111 and 112 were tested for preservability and processability, which results are shown in Tables 3 and 4.

Samples 102 and 112 according to the present invention showed excellent preservability and less change in sensitivity during storage compared to comparative samples 101 and 111. Further, change in fog was successfully suppressed. Particularly, Sample 102 showed less change in sensitivity than Sample 112.

TABLE 3

| Sample | Compound according to invention | Fine silver bromide grains in 14th layer | Photographic properties (immediately after preparation) Fog | Relative sensitivity | Fog at 60° C., 30% RH | Sensitivity after 3 days storage |
|---|---|---|---|---|---|---|
| 101 | — | included | BL ±0(standard for BL) | 100(standard for BL) | +0.15 | 76 |
| | | | GL ±0(standard for GL) | 100(standard for GL) | +0.16 | 74 |
| | | | RL ±0(standard for RL) | 100(standard for RL) | +0.20 | 70 |
| 102 (invention) | (11) | included | BL −0.02 | 102 | +0.03 | 100 |
| | | | GL −0.03 | 100 | +0.04 | 98 |
| | | | RL −0.02 | 105 | +0.05 | 102 |
| 111 | — | no | BL −0.02 | 81 | +0.09 | 68 |
| | | | GL ±0 | 99 | +0.16 | 73 |
| | | | RL ±0 | 97 | +0.20 | 67 |
| 112 (invention) | (11) | no | BL −0.04 | 83 | +0.02 | 80 |
| | | | GL −0.03 | 99 | +0.04 | 97 |
| | | | RL −0.02 | 102 | +0.05 | 99 |

TABLE 4

| Sample | Replenisher | $R_1$ | $R_2$ | $R_3$ | $R_4$ |
|---|---|---|---|---|---|
| 101 | Relative sensitivity | 100 (standard) | 98 | 96 | 94 |
| | Fog value | ±0 (standard) | −0.01 | −0.01 | −0.02 |
| 102 (invention) | Relative sensitivity | 102 | 100 | 99 | 98 |
| | Fog value | −0.02 | −0.02 | −0.02 | −0.02 |
| 111 | Relative sensitivity | 81 | 79 | 76 | 74 |
| | Fog value | −0.02 | −0.02 | −0.03 | −0.03 |
| 112 (invention) | Relative sensitivity | 83 | 81 | 78 | 76 |
| | Fog value | −0.04 | −0.04 | −0.05 | −0.05 |

Example 3

Samples 121 to 126 were prepared in a similar way as in Samples 101 and 102 provided that the content of silver iodide in a silver iodobromide emulsion was varied as shown in table 5. Samples 101, 102 and 121 to 126 were tested for photographic properties and preservability, which results are shown in Table 6, and for processability, which results are shown in Table 7.

Samples 102, 122, 124 and 126 which contained compound (11) according to the invention showed better preservability than Samples 101, 121, 123 and 125. However, the difference became smaller with the increasing average amount of silver iodide.

Although the change in sensitivity in the processability tests become larger with the increasing average content of silver iodide, the processabilities of Samples 102, 122, 124 and 126 according to the invention were more than comparable, and their preservabilities were better. Particularly, the lower the average content of silver iodide, the better the results.

TABLE 5

| Emulsion layer (g of Ag/m²) | Sample 101 | 102 | 121 | 122 | 123 | 124 | 125 | 126 |
|---|---|---|---|---|---|---|---|---|
| First red-sensitive layer (0.4) | 2% | 2% | 2% | 2% | 2% | 2% | 2% | 2% |
| Second red-sensitive layer (0.7) | 5 | 5 | 5 | 5 | 6 | 6 | 10 | 10 |
| Third red-sensitive layer (0) | 10 | 10 | 12 | 12 | 12 | 12 | 12 | 12 |
| First green-sensitive layer (0.3) | 4 | 4 | 4 | 4 | 4 | 4 | 4 | 4 |
| Second green-sensitive layer (0.4) | 5 | 5 | 5 | 5 | 5 | 5 | 10 | 10 |
| Third green-sensitive layer (0.85) | 6 | 6 | 10 | 10 | 12 | 12 | 12 | 12 |
| First blue-sensitive layer (0.4) | 4 | 4 | 4 | 4 | 10 | 10 | 10 | 10 |
| Second blue-sensitive layer (0.5) | 10 | 10 | 12 | 12 | 12 | 12 | 12 | 12 |
| Second protective layer (0.5) (total 5.05 g/m²) | 0 | 0 | 0 | 0 | 0 | 0 | 0 | 0 |
| Average content of silver iodide (mol %) | 5.78 | 5.78 | 7.05 | 7.05 | 8.0 | 8.0 | 8.95 | 8.95 |
| Compound of the invention | no | (11) | no | (11) | no | (11) | no | (11) |

TABLE 6

| Sample | Compound of the invention | Average content of silver iodide (%) | Photographic properties immediately after preparation Fog | Relative sensitivity | Photographic properties after 3 days storage at 60° C., 35% RH Fog | Relative sensitivity |
|---|---|---|---|---|---|---|
| 101 | — | 5.78 | BL ±0 | 100 | +0.15 | 76 |
| | | | GL ±0 | 100 | +0.16 | 74 |
| | | | RL ±0 | 100 | +0.20 | 70 |
| 102 | (11) | 5.78 | BL −0.02 | 102 | +0.03 | 100 |
| | | | GL −0.03 | 100 | +0.04 | 98 |
| | | | RL −0.02 | 105 | +0.05 | 102 |
| 121 | — | 7.05 | BL −0.01 | 120 | +0.10 | 95 |
| | | | GL −0.01 | 108 | +0.12 | 83 |
| | | | RL −0.01 | 103 | +0.17 | 75 |
| 122 | (11) | 7.05 | BL −0.03 | 122 | +0.02 | 120 |
| | | | GL −0.03 | 108 | +0.03 | 106 |
| | | | RL −0.02 | 107 | +0.04 | 104 |
| 123 | — | 8.00 | BL −0.01 | 121 | +0.07 | 98 |
| | | | GL −0.01 | 109 | +0.09 | 87 |

TABLE 6-continued

| Sample | Compound of the invention | Average content of silver iodide (%) | Photographic properties immediately after preparation | | Photographic properties after 3 days storage at 60° C., 35% RH | |
|---|---|---|---|---|---|---|
| | | | Fog | Relative sensitivity | Fog | Relative sensitivity |
| | | | RL −0.01 | 103 | +0.13 | 79 |
| 124 | (11) | 8.00 | BL −0.03 | 123 | +0.02 | 122 |
| | | | GL −0.03 | 109 | +0.02 | 107 |
| | | | RL −0.03 | 107 | +0.03 | 105 |
| 125 | — | 8.95 | BL −0.01 | 121 | +0.07 | 98 |
| | | | GL −0.02 | 109 | +0.07 | 89 |
| | | | RL −0.02 | 103 | +0.11 | 81 |
| 126 | (11) | 8.95 | BL −0.03 | 123 | +0.02 | 122 |
| | | | GL −0.03 | 109 | +0.02 | 107 |
| | | | RL −0.03 | 107 | +0.03 | 106 |

TABLE 7

| Sample | Compound of the invention | Average content of silver iodide (%) | | Replenisher | | | |
|---|---|---|---|---|---|---|---|
| | | | | $R_1$ | $R_2$ | $R_3$ | $R_4$ |
| 101 | — | 5.78 | Relative sensitivity | 100 | 98 | 96 | 94 |
| | | | Fog value | ±0 | −0.01 | −0.01 | −0.02 |
| 102 | (11) | 5.78 | Relative sensitivity | 102 | 100 | 99 | 98 |
| | | | Fog value | −0.02 | −0.02 | −0.02 | −0.02 |
| 121 | — | 7.05 | Relative sensitivity | 120 | 118 | 116 | 114 |
| | | | Fog value | −0.01 | −0.02 | −0.02 | −0.03 |
| 122 | (11) | 7.05 | Relative sensitivity | 122 | 120 | 117 | 115 |
| | | | Fog value | −0.03 | −0.03 | −0.03 | −0.03 |
| 123 | — | 8.00 | Relative sensitivity | 121 | 118 | 115 | 107 |
| | | | Fog value | −0.01 | −0.02 | −0.02 | −0.03 |
| 124 | (11) | 8.00 | Relative sensitivity | 123 | 119 | 116 | 109 |
| | | | Fog value | −0.03 | −0.03 | −0.03 | −0.04 |
| 125 | — | 8.95 | Relative sensitivity | 121 | 114 | 107 | 97 |
| | | | Fog value | −0.01 | −0.02 | −0.04 | −0.04 |
| 126 | (11) | 8.95 | Relative sensitivity | 123 | 115 | 108 | 98 |
| | | | Fog value | −0.03 | −0.03 | −0.04 | −0.04 |

What we claim is:

1. A method of processing continuously a silver halide color photographic light-sensitive material comprising the step of developing said material while supplying a replenisher to a developing bath, wherein the volume of the replenisher is 900 ml or less per $m^2$ of the light-sensitive materials to be developed and the light-sensitive material includes at least one compound represented by the following formula:

$$Q—SM^1 \quad (I)$$

wherein Q represents a heterocyclic residue to which at least one selected from the group consisting of $—SO_3M^2$ and $—COOM^2$, is directly or indirectly attached, $M^1$ and $M^2$ independently represent a hydrogen atom, alkali metal, quaternary ammonium ion, or quaternary phosphonium ion.

2. The method according to claim 1, wherein said light-sensitive material is provided with a later containing non-light-sensitive fine silver halide grains of an average grain size of 0.2 μ or less outside a light-sensitive silver halide emulsion layer furtherest from a substrate.

3. The method according to claim 1, wherein an average ratio of silver iodide to the whole silver halide included in the light-sensitive material is 8 mol% or less.

4. The method according to claim 1, wherein said mercapto compound is represented by the following formula II or III:

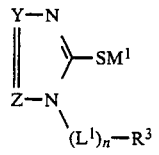

(II)

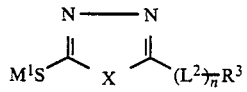

(III)

wherein, X represents a sulfur atom, oxygen atom or

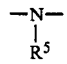

wherein $R^5$ is a hydrogen atom, a substituted or unsubstituted alkyl group or a substituted or unsubstitutued aryl group, Y and Z independently represent a nitrogen atom or $CR^4$ wherein $R^4$ is a hydrogen atom, a substituted or unsubstituted alkyl group or a substituted or unsubstituted aryl group, $R^3$ is an organic residue substituted with at least one selected from a group consisting of $—SO_3M^2$ $—COOM^2L^1$ represents a connecting group selected from a group consisting of —S—, —O—, —N—, —CO—, —SO— and $—SO_2—$, n is zero or 1, $L^2$ represents $—CONR^6—$, $—NR^6CO—$, $—SO_2NR^6—$, $—NR^6SO_2—$, —OCO—, —COO—, —S—, $—NR^6—$, —CO—, —SO—, —OCOO—, $—NR^6CONR^7—$, —$NR^6COO$—, —$OCONR^6$—, or —$NR^6SO_2NR^7$—, $R^6$ and $R^7$ each represent a hydrogen atom, a substituted or unsubstituted alkly group or a substituted or unsubstituted aryl group.

5. The method according to claim 1 wherein said compound is included in a silver halide emulsion layer or its vicinal layers.

6. The method according to claim 1, wherein said compound is included in an amount of from $1\times10^{-5}$ to $1\times10^{-1}$ g/m$^2$.

7. The method according to claim 1, wherein said light-sensitive material is a color negative light-sensitive material for photography or reversal type light-sensitive material.

8. The method according to claim 1, wherein said light-sensitive material is a high sensitive photographic color film which comprises a substrate having provided thereon at least two emulsion layers which have the same color sensitivity but different sensitivities in speed.

9. The method according to claim 1, wherein the volume of the replenisher to the developing bath is 800 ml or less per m$^2$ of the light-sensitive materials to be developed.

10. The method according to claim 1, wherein the volume of replenisher to the devleoping bath is 600 ml or less per m$^2$ bf the light-sensitive materials to be developed.

11. The method according to claim 1, wherein the silver halide color light-sensitive material contains coated silver in an amount of 7.5 g/m$^2$ or less.

12. The method according to claim 1, wherein the silver halide color light-sensitive material contains coated silver in an amount of 5.5 g/m$^2$ or less.

13. The method according to claim 1, wherein the light-sensitive material contains a 4-equivalent coupler in an amount of 50 mol % or less based on the total amount of couplers included in the light-sensitive material.

14. The method according to claim 13, wherein the amount of 4-equivalent coupler is 40 mol % or less based on the total amount of couplers included in the light-sensitive materials.

15. A method of processing continuously a silver halide color photographic light-sensitive material comprising the step of developing said material while supplying a replenisher to a developing bath, wherein the volume of the replenisher is 900 ml or less per m$^2$ of the light-sensitive materials to be developed and the light-sensitive material includes silver iodide in an amount of 8 mol % or less based on the total amount of silver halide.

16. A method of processing continuously a silver halide color photographic light-sensitive material comprising the step of developing said material while supplying a replenisher to a developing bath, wherein the volume of the replenisher is 900 ml or less per m$^2$ of the light-sensitive materials to be developed and the light sensitive material includes a 4- equivalent coupler in an amount of 50 mol % or less based on the total amount of couplers.

17. A method of processing continuously a silver halide color photographic light-sensitive material comprising the step of developing said material while supplying a replenisher to a developing bath, wherein the volume of the replenisher is 900 ml or less per m$^2$ of the light-sensitive materials to be developed and the light-sensitive material is provided with a layer containing non-light-sensitive fine silver halide grains of an average grain size of 0.2 $\mu$ or less outside a light-sensitive silver halide emulsion layer furthest from a substrate.

* * * * *